US007476339B2

(12) United States Patent
Czubarow et al.

(10) Patent No.: US 7,476,339 B2
(45) **Date of Patent: *Jan. 13, 2009**

(54) HIGHLY FILLED THERMOPLASTIC COMPOSITES

(75) Inventors: Pawel Czubarow, Wellesley, MA (US); Gwo Swei, Vandalia, OH (US); Oh-Hun Kwon, Westborough, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/507,062

(22) Filed: Aug. 18, 2006

(65) Prior Publication Data

US 2008/0042107 A1 Feb. 21, 2008

(51) Int. Cl.
*H01B 1/00* (2006.01)
*H01B 1/22* (2006.01)

(52) U.S. Cl. ..... 252/500; 252/513; 428/34.1; 428/323; 428/332; 428/411.1; 523/214; 524/423; 524/440; 524/492; 524/600; 525/471; 525/488

(58) Field of Classification Search ..... 428/34.1, 428/76, 323, 332, 411.1; 430/311; 525/471, 525/488; 524/423, 440, 488, 492, 600; 252/513, 252/500; 442/492; 528/125; 606/69; 523/214
See application file for complete search history.

(56) References Cited

U.S. PATENT DOCUMENTS

| | | | | |
|---|---|---|---|---|
| 3,179,631 A | | 4/1965 | Endrey | |
| 3,249,588 A | | 5/1966 | Gall | |
| 3,287,311 A | * | 11/1966 | Edwards | 524/600 |
| 3,422,061 A | | 1/1969 | Gall | |
| 3,850,820 A | | 11/1974 | Korshak et al. | |
| 4,125,514 A | * | 11/1978 | Stabler | 523/214 |
| 4,183,839 A | | 1/1980 | Gagliani | |
| 4,413,117 A | | 11/1983 | Reiter et al. | |
| 4,643,910 A | | 2/1987 | Foutz | |
| 4,670,325 A | | 6/1987 | Bakos et al. | |
| 4,699,841 A | | 10/1987 | Kundinger et al. | |
| 4,804,582 A | * | 2/1989 | Noding et al. | 428/332 |
| 4,806,414 A | * | 2/1989 | Brouwer | 442/149 |
| 5,000,813 A | | 3/1991 | Hill | |
| 5,021,540 A | | 6/1991 | Leone-Bay et al. | |

(Continued)

FOREIGN PATENT DOCUMENTS

EP 0 192 937 B1 9/1986

(Continued)

OTHER PUBLICATIONS

Milliken Chemical Homepage, Zelec ECP Electrical Powders, www.zelec-ecp.com.*

(Continued)

*Primary Examiner*—Douglas M C Ginty
*Assistant Examiner*—Khanh Tuan Nguyen
(74) *Attorney, Agent, or Firm*—Larson Newman Abel & Polansky, LLP; Robert T. Conway

(57) ABSTRACT

A composite material including a thermoplastic polymer matrix and a non-carbonaceous resistivity modifier dispersed in the thermoplastic polymer matrix. The composite material has a surface resistivity of about $1.0\times10^4$ ohm/sq to about $1.0\times10^{11}$ ohm/sq and at least a portion of a surface of the composite material has a surface roughness (Ra) not greater than about 500 nm.

14 Claims, 1 Drawing Sheet

U.S. PATENT DOCUMENTS

| | | | | |
|---|---|---|---|---|
| 5,041,520 | A | | 8/1991 | Ohta et al. |
| 5,066,424 | A | * | 11/1991 | Dixon et al. ..... 252/513 |
| 5,122,563 | A | | 6/1992 | Kaminski et al. |
| 5,138,028 | A | | 8/1992 | Paul et al. |
| 5,173,519 | A | | 12/1992 | Moy et al. |
| 5,188,876 | A | | 2/1993 | Hensel et al. |
| 5,189,129 | A | | 2/1993 | Gerber et al. |
| 5,208,103 | A | | 5/1993 | Miyamoto et al. |
| 5,232,775 | A | * | 8/1993 | Chamberlain et al. ..... 428/323 |
| 5,273,815 | A | | 12/1993 | Brydon et al. |
| 5,276,080 | A | | 1/1994 | Oku |
| 5,279,895 | A | | 1/1994 | Ogasawara et al. |
| 5,290,906 | A | * | 3/1994 | Matsumura et al. ..... 528/125 |
| 5,298,558 | A | | 3/1994 | Sullivan et al. |
| 5,300,592 | A | * | 4/1994 | Kanagawa et al. ..... 525/488 |
| 5,374,453 | A | | 12/1994 | Swei et al. |
| 5,434,009 | A | | 7/1995 | Urbanek |
| 5,460,746 | A | | 10/1995 | Yamamoto et al. |
| 5,478,915 | A | | 12/1995 | Amone et al. |
| 5,504,138 | A | | 4/1996 | Jacobs |
| 5,506,049 | A | | 4/1996 | Swei et al. |
| 5,516,816 | A | | 5/1996 | Samuels |
| 5,530,047 | A | | 6/1996 | Watanabe et al. |
| 5,717,018 | A | | 2/1998 | Magerstedt et al. |
| 5,846,621 | A | | 12/1998 | Nagamatsu |
| 5,885,706 | A | | 3/1999 | Bergmann et al. |
| 5,886,129 | A | | 3/1999 | DeColibus |
| 5,922,440 | A | | 7/1999 | Schlueter, Jr. et al. |
| 5,945,213 | A | | 8/1999 | Nagaike et al. |
| 5,962,608 | A | | 10/1999 | Ryang et al. |
| 6,103,864 | A | | 8/2000 | Alston et al. |
| 6,117,246 | A | | 9/2000 | Parkhe et al. |
| 6,140,405 | A | | 10/2000 | Eckstein et al. |
| 6,215,641 | B1 | | 4/2001 | Busse et al. |
| 6,432,509 | B1 | | 8/2002 | Furuya et al. |
| 6,436,605 | B1 | | 8/2002 | Angelopoulos et al. |
| 6,447,937 | B1 | | 9/2002 | Murakawa et al. |
| 6,517,774 | B1 | | 2/2003 | Bray et al. |
| 6,540,945 | B2 | | 4/2003 | Kubotera et al. |
| 6,548,180 | B2 | | 4/2003 | Yamamoto et al. |
| 6,652,958 | B2 | | 11/2003 | Tobita |
| 6,667,360 | B1 | * | 12/2003 | Ng et al. ..... 524/492 |
| 6,689,835 | B2 | | 2/2004 | Amarasekera et al. |
| 6,727,334 | B2 | | 4/2004 | Nishiwaki et al. |
| 6,740,260 | B2 | | 5/2004 | McCord |
| 6,787,610 | B2 | | 9/2004 | Morimoto et al. |
| 6,832,963 | B2 | | 12/2004 | Sulivan et al. |
| 7,041,374 | B1 | * | 5/2006 | Nelson et al. ..... 428/411.1 |
| 2003/0049056 | A1 | | 3/2003 | Finn et al. |
| 2003/0181626 | A1 | | 9/2003 | Lindway |
| 2004/0132900 | A1 | | 7/2004 | Sachdev et al. |
| 2005/0056601 | A1 | | 3/2005 | Bhatt et al. |
| 2005/0100724 | A1 | | 5/2005 | Seargeant |
| 2005/0175827 | A1 | | 8/2005 | Hebrink et al. |
| 2005/0237473 | A1 | | 10/2005 | Stephenson et al. |
| 2006/0027790 | A1 | | 2/2006 | Arai et al. |
| 2006/0030681 | A1 | * | 2/2006 | Sawyer et al. ..... 525/471 |
| 2006/0047030 | A1 | | 3/2006 | Yoshida et al. |
| 2006/0068329 | A1 | | 3/2006 | Aylward et al. |
| 2006/0142455 | A1 | * | 6/2006 | Agarwal et al. ..... 524/423 |
| 2006/0155034 | A1 | * | 7/2006 | Gijsman et al. ..... 524/440 |
| 2006/0247638 | A1 | * | 11/2006 | Trieu et al. ..... 606/69 |
| 2007/0020450 | A1 | * | 1/2007 | Kitamura et al. ..... 428/332 |
| 2007/0026171 | A1 | * | 2/2007 | Extrand ..... 428/34.1 |
| 2007/0152195 | A1 | | 7/2007 | Czubarow et al. |
| 2007/0154716 | A1 | | 7/2007 | Czubarow et al. |
| 2007/0154717 | A1 | | 7/2007 | Beltz et al. |
| 2007/0155949 | A1 | | 7/2007 | Beltz et al. |

FOREIGN PATENT DOCUMENTS

| | | | | |
|---|---|---|---|---|
| EP | 0 210 775 | A1 | | 2/1987 |
| EP | 0 405 378 | A2 | | 1/1991 |
| EP | 0 409 099 | A2 | | 1/1991 |
| EP | 0 418 066 | A2 | | 3/1991 |
| EP | 0 422 919 | A2 | | 4/1991 |
| EP | 0 455 571 | A2 | | 11/1991 |
| EP | 0 466 061 | A2 | | 1/1992 |
| EP | 0 329 475 | A2 | | 1/1994 |
| EP | 0 626 412 | A1 | | 9/1997 |
| EP | 0 633 295 | A1 | | 1/2002 |
| EP | 1 227 824 | A1 | | 8/2004 |
| EP | 1 153 984 | B1 | | 10/2004 |
| EP | 1 059 324 | A1 | | 11/2004 |
| EP | 0 822 224 | A2 | | 4/2005 |
| EP | 1 177 252 | B1 | | 6/2005 |
| EP | 0 902 048 | A1 | | 11/2005 |
| GB | 1396332 | | | 6/1975 |
| GB | 2 176 193 | A | | 12/1986 |
| GB | 2295155 | A | | 5/1996 |
| JP | 63-172741 | A | | 7/1988 |
| JP | 63-193935 | A | | 8/1988 |
| JP | 63-301259 | | * | 12/1988 |
| JP | 01-146970 | A | | 6/1989 |
| JP | 01-201606 | A | | 8/1989 |
| JP | 04 201433 | A | | 7/1992 |
| JP | 07-331069 | A | | 12/1995 |
| JP | 2746213 | B2 | | 5/1998 |
| JP | 11-292999 | | * | 10/1999 |
| JP | 11292999 | A | | 10/1999 |
| JP | 2003-221505 | A | | 8/2003 |
| JP | 2005112942 | A | | 4/2005 |
| WO | WO 89/00755 | | | 1/1989 |
| WO | WO 98/21626 | | | 5/1998 |
| WO | WO 98/27789 | | | 6/1998 |
| WO | WO 99/36130 | | | 7/1999 |
| WO | WO 00/06470 | | | 2/2000 |
| WO | WO 00/17262 | | | 3/2000 |
| WO | WO 02/077076 | A1 | | 10/2002 |
| WO | WO 03/085030 | A1 | | 10/2003 |
| WO | WO 03/095574 | A1 | | 11/2003 |
| WO | 2004133103 | A | | 4/2004 |
| WO | WO 2004/030427 | A1 | | 4/2004 |
| WO | WO 2004/076560 | A1 | | 9/2004 |
| WO | 2005033188 | A | | 4/2005 |
| WO | WO 2005/036563 | A2 | | 4/2005 |
| WO | WO 2006/039230 | A1 | | 4/2006 |
| WO | 2007078969 | A | | 7/2007 |

OTHER PUBLICATIONS

Schaller, E. J., "Critical Pigment Volume Concentration Of Emulsion Based Paints", Jounal of Paint Technology, vol. 10, No. 525, pp. 433-438, Oct. 1968.

Reddy, J. N., et al., "Studies on Adhesion: Role of Pigments", Jounal of Paint Technology, vol. 44, No. 566, pp. 70-75, Mar. 1972.

Wiita, R. E., "Vehicle CPVC", Journal of Paint Technology, vol. 45, No. 578, pp. 72-79, Mar. 1973.

Koton, M. M., et al., "Thermal Stabilization of Polyimides by Triphenyl Phosphate", Translation from Zhurnal Prikladnoi Khimii, vol. 56, No. 3, pp. 617-623, Mar. 1983.

Swavely,T.W., Quadrant Engineering Plastic Products, Material Safety Data Sheet, MSDS#1502, Aug. 28, 2001.

Swavely, T.W., Quadrant Engineering Plastic Products, Material Safety Data Sheet, MSDS#2150, May 30, 2003.

Semitron ESd 410C PEI Specifications, Shiner, Texas, Copyright Boedeker Plastics, Inc., 2005.

Semitron ESd 410C Product Data Sheet, Copyright Quadrant AG, Jan. 2003.

Machine transition of JP 2003-138039, Published May 14, 2003, Kanegafuchi Chem Ind Co Ltd.

* cited by examiner

HIGHLY FILLED THERMOPLASTIC COMPOSITES

FIELD OF THE DISCLOSURE

This disclosure, in general, relates to highly filled thermoplastic composite materials.

BACKGROUND

In an increasingly technological age, static electricity and electrostatic discharge (ESD) can be costly or dangerous. In particular, electrostatic discharge (ESD) can ignite flammable mixtures and damage electronic components. In addition, static electricity can attract contaminants in clean environments.

Such effects of static electricity and ESD can be costly in electronic device manufacturing. Contaminants attracted by static charge may cause defects in components of electronic devices, leading to poor performance. In addition, ESD can damage components, making a device completely inoperable or reducing device performance or life expectancy. Such losses in performance lead to lower value products, and, in some instances, lost production and a higher rejection rate of parts, resulting in higher unit cost As electronic devices become increasing complex and component sizes decrease, the electronic devices become more susceptible to ESD. In addition, manufacturing of such devices uses intricate processing tools that may be difficult to form from metal. Metal components exhibit transient currents that may result in electrostatic discharge, for example, when first contacting parts. More recently, manufacturers have turned to ceramic materials for use in manufacturing such electronic devices. While ceramic materials are typically insulative, manufacturers use coatings and additives to provide electrostatic dissipative properties to such ceramic materials.

While ceramic materials tend to have high Young's modulus, high wear resistance, and dimensional stability at high temperatures, ceramic materials may be difficult to form and machine into intricate tools and components useful in electronic devices. Typically, formation of ceramic components includes densification performed at high temperatures, often exceeding 1200° C. Once formed, typical electrostatic dissipative ceramics exhibit high density and increased hardness, in some instances exceeding 11 GPa Vicker's hardness, making it difficult to machine detail into ceramic components.

More recently, manufacturers have turned to polymeric electrostatic dissipative materials. Much like ceramic materials, polymeric materials are generally insulative. As such, polymeric materials are typically coated with an electrostatic dissipative coating or include additives, such as graphite or carbon fiber. While such materials may be easier to form into tooling and electronic components, such polymeric materials typically exhibit poor mechanical properties and poor physical properties relative to ceramic materials. For example, such polymeric materials often exhibit unacceptably low tensile strength and high coefficients of thermal expansion, limiting the applications in which such materials may be useful. Further, such polymeric materials exhibit poor mechanical property retention after exposure to high temperatures. In addition, such polymeric materials often use carbon fibers, carbon black, or graphite. When machined into intricate components having small feature sizes, such materials can have rough surfaces and can form shorts and hot spots, leading to electrostatic discharge.

As such, an improved electrostatic dissipative material would be desirable.

SUMMARY

In a particular embodiment, a composite material including a thermoplastic polymer matrix and a non-carbonaceous resistivity modifier dispersed in the thermoplastic polymer matrix. The composite material has a surface resistivity of about $1.0\times10^4$ ohm/sq to about $1.0\times10^{11}$ ohm/sq and at least a portion of a surface of the composite material has a surface roughness (Ra) not greater than about 500 nm.

In another exemplary embodiment, a composite material includes a thermoplastic polymer matrix and at least about 67 wt % non-carbonaceous resistivity modifier dispersed in the polymer matrix. The composite material has a surface resistivity of about $1.0\times10^4$ ohm/sq to about $1.0\times10^{11}$ ohm/sq.

In a further exemplary embodiment, a composite material includes a polyarylether ketone matrix and at least about 67 wt % of a non-carbonaceous resistivity modifier dispersed in the polyarylether ketone matrix. The composite material has a surface resistivity of about $1.0\times10^4$ ohm/sq to about $1.0\times10^{11}$ ohm/sq.

In an additional exemplary embodiment, a composite material includes a polyetheretherketone (PEEK) matrix and at least about 67 wt % of an oxide of iron dispersed within the PEEK matrix.

In another exemplary embodiment, a method of forming a composite material includes compounding a polyarylether ketone powder and about 67% by weight of a non-carbonaceous resistivity modifier to form a composite material. The composite material includes a matrix of polyarylether ketone having the non-carbonaceous resistivity modifier dispersed therein.

In a further exemplary embodiment, a tool useful for electronic device manufacturing includes a device contact component. The device contact component includes a composite material including a thermoplastic polymer matrix and a non-carbonaceous resistivity modifier dispersed in the thermoplastic polymer matrix. The composite material has a surface resistivity of about $1.0\times10^4$ ohm/sq to about $1.0\times10^{11}$ ohm/sq and at least a portion of a surface of the composite material has a surface roughness (Ra) not greater than about 500 nm.

BRIEF DESCRIPTION OF THE DRAWINGS

The present disclosure may be better understood, and its numerous features and advantages made apparent to those skilled in the art by referencing the accompanying drawings.

DESCRIPTION OF THE EMBODIMENTS

Figure 1:
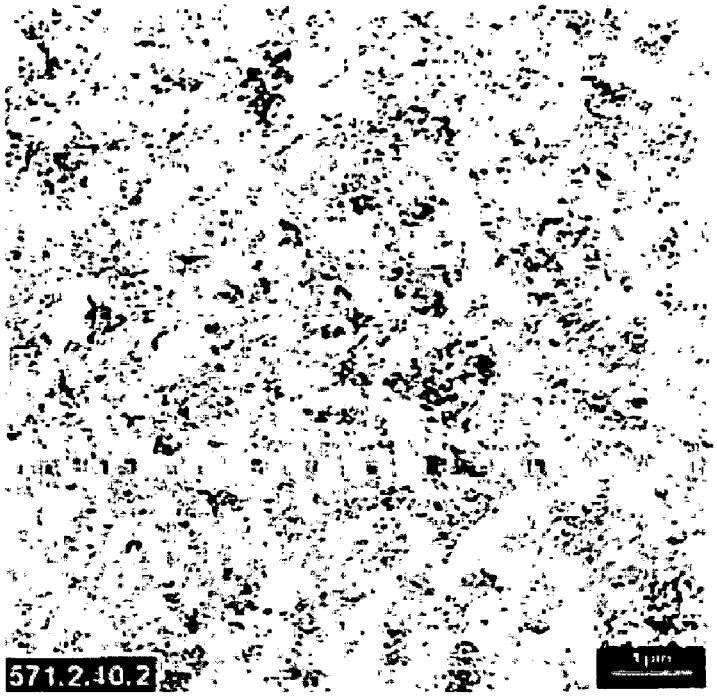
FIG. 1 and FIG. 2 include illustrations of exemplary polymer matrices including dispersed non-carbonaceous resistivity modifier.

In a particular embodiment, an article is formed of a composite material having a surface resistivity of about $1.0\times10^4$ ohm/sq to about $1.0\times10^{11}$ ohm/sq. The composite material includes a polymer matrix and a non-carbonaceous resistivity modifier. In an example, the polymer matrix is formed of a polymer having an ether bond between two monomers of the polymer. For example, the polymer may be a polyether or a polyaryletherketone. The non-carbonaceous resistivity modifier may be dispersed in the polymer matrix in an amount of at least about 67 wt %. In a particular example, the non-carbonaceous resistivity modifier includes an oxide of iron.

In an exemplary embodiment, a composite material includes a polymer matrix and a non-carbonaceous resistivity modifier. For example, the polymer matrix may be formed of a thermoplastic polymer. An exemplary polymer includes polyamide, polyphenylsulfide, polycarbonate, polyether, polyketone, polyaryletherketone, or any combination thereof. In an example, the polymer includes an ether bond in the backbone of the polymer (i.e., two monomers of the polymer are bonded together by an ether group). For example, the polymer may include polyether, polyaryletherketone, or any combination thereof. An exemplary polyaryletherketone may include polyetherketone, polyetheretherketone, polyetheretherketoneketone, or any combination thereof. In a particular example, the polyaryletherketone may include polyetheretherketone (PEEK).

The polymer matrix may be formed of a polymer formed from one or more monomers. For example, the polymer may be formed from at least one dihalide and at least one bisphenolate salt. In an example, the dihalide may include an aromatic dihalide, such as a benzophenone dihalide. The at least one bisphenolate salt may include an alkali bisphenolate.

The resistivity modifier is generally non-carbonaceous. Carbonaceous materials are those materials, excluding polymer, that are formed predominantly of carbon (or organic materials processed to form predominantly carbon), such as graphite, amorphous carbon, diamond, carbon fibers, and fullerenes. Non-carbonaceous materials typically refer to inorganic materials, which are carbon free or, if containing carbon, the carbon is covalently bonded to a cation, such as in the form of a metal carbide material (i.e., carbide ceramic). In an example, the non-carbonaceous resistivity modifier includes a metal oxide, a metal sulfide, a metal nitride, a metal boride, a metal carbide, a silicide, a doped semiconductor having a desirable resistivity, or any combination thereof. Metal is intended to include metals and semi-metals, including semi-metals of groups 13, 14, 15, and 16 of the periodic table. For example, the non-carbonaceous resistivity modifier may be a carbide or an oxide of a metal. In a particular example, the non-carbonaceous resistivity modifier is an oxide of a metal.

A particular non-carbonaceous resistivity modifier may include NiO, FeO, MnO, $Co_2O_3$, $Cr_2O_3$, CuO, $Cu_2O$, $Fe_2O_3$, $Ga_2O_3$, $In_2O_3$, $GeO_2$, $MnO_2$, $TiO_{2-x}$, $RuO_2$, $Rh_2O_3$, $V_2O_3$, $Nb_2O_5$, $Ta_2O_5$, $WO_3SnO_2$, ZnO, $CeO_2$, $TiO_{2-x}$, ITO (indium-tin oxide), $MgTiO_3$, $CaTiO_3$, $BaTiO_3$, $SrTiO_3$, $LaCrO_3$, $LaFeO_3$, $LaMnO_3$, $YMnO_3$, $MgTiO_3F$, $FeTiO_3$, $SrSnO_3$, $CaSnO_3$, $LiNbO_3$, $Fe_3O_4$, $MgFe_2O_4$, $MnFe_2O_4$, $CoFe_2O_4$, $NiFe_2O_4$ $ZnFe_2O_4$, $Fe_2O_4$, $CoFe_2O_4$, $FeAl_2O_4$, $MnAl_2O_4$, $ZnAl_2O_4$, $ZnLa_2O_4$, $FeAl_2O_4$, $MgIn_2O_4$, $MnIn_2O_4$, $FeCr_2O_4$, $NiCr_2O_4$, $ZnGa_2O_4$, $LaTaO_4$, $NdTaO_4$, $BaFe_{12}O_{19}$, $3Y_2O_3.5Fe_2O_3$, $Bi_2Ru_2O_7$, $B_4C$, SiC, TiC, Ti(CN), $Cr_4C$, VC, ZrC, TaC, WC, $Si_3N_4$, TiN, Ti(ON), ZrN, HfN, $TiB_2$, $ZrB_2$, $CaB_6$, $LaB_6$, $NbB_2$, $MoSi_2$, ZnS, Doped-Si, doped SiGe, III-V, II-VI semiconductors, or a mixture thereof. For example, the non-carbonaceous resistivity modifier may include an oxide, such as a single oxide of the general formula MO, such as NiO, FeO, MnO, $Co_2O_3$, $Cr_2O_3$, CuO, $Cu_2O$, $Fe_2O_3$, $Ga_2O_3$, $In_2O_3$, $GeO_2$, $MnO_2$, $TiO_{2-x}$, $RuO_2$, $Rh_2O_3$, $V_2O_3$, $Nb_2O_5$, $Ta_2O_5$, or $WO_3$. In another example, the non-carbonaceous resistivity modifier may include a doped oxide, such as $SnO_2$, ZnO, $CeO_2$, $TiO_{2-x}$, or ITO (indium-tin oxide). In a further example, the non-carbonaceous resistivity modifier may include a mixed oxide. For example, the mixed oxide may have a perovskite structure, such as $MgTiO_3$, $CaTiO_3$, $BaTiO_3$, $SrTiO_3$, $LaCrO_3$, $LaFeO_3$, $LaMnO_3$, $YMnO_3$, $MgTiO_3F$, $FeTiO_3$, $SrSnO_3$, $CaSnO_3$, or $LiNbO_3$. In an additional example, the mixed oxide may have a spinel structure, such as $Fe_3O_4$, $MgFe_2O_4$, $MnFe_2O_4$, $CoFe_2O_4$, $NiFe_2O_4$ $ZnFe_2O_4$, $Fe_2O_4$, $CoFe_2O_4$, $FeAl_2O_4$, $MnAl_2O_4$, $ZnAl_2O_4$, $ZnLa_2O_4$, $FeAl_2O_4$, $MgIn_2O_4$, $MnIn_2O_4$, $FeCr_2O_4$, $NiCr_2O_4$, $ZnGa_2O_4$, $LaTaO_4$, or $NdTaO_4$. In another example, the mixed oxide may include a magnetoplumbite material, such as $BaFe_{12}O_{19}$. In a further example, the mixed oxide may have a garnet structure, such as $3Y_2O_3.5Fe_2O_3$. In an additional example, the mixed may include other oxides, such as $Bi_2Ru_2O_7$. In another example, the non-carbonaceous resistivity modifier may include a carbide material having the general formula MC, such as $B_4C$, SiC, TiC, Ti(CN), $Cr_4C$, VC, ZrC, TaC, or WC. In a particular example, the non-carbonaceous resistivity modifier includes SiC. In a further example, the non-carbonaceous resistivity modifier may include a nitride material having the general formula MN, such as $Si_3N_4$, TiN, Ti(ON), ZrN, or HfN. In an additional example, the non-carbonaceous resistivity modifier may include a boride, such as $TiB_2$, $ZrB_2$, $CaB_6$, $LaB_6$, $NbB_2$. In another example, the non-carbonaceous resistivity modifier may include a silicide such as $MoSi_2$, a sulfide such as ZnS, or a semiconducting material such as doped-Si, doped SiGe, or III-V, II-VI semiconductors. In a particular example, the non-carbonaceous resistivity modifier includes an oxide of iron, such as $Fe_2O_3$. In another particular example, the non-carbonaceous resistivity modifier includes an oxide of copper, such as CuO and $Cu_2O$. In addition, mixtures of these fillers may be used to further tailor the properties of the resulting composite materials, such as resistivity, surface resistance, and mechanical properties. Further electrical properties may be influenced by doping oxides with other oxides or by tailoring the degree of non-stoichiometric oxidation.

In general, the non-carbonaceous resistivity modifier has a desirable resistivity. In an exemplary embodiment, the non-carbonaceous resistivity modifier has a resistivity of about $1.0\times10^{-2}$ ohm-cm to about $1.0\times10^{7}$ ohm-cm, such as about 1.0 ohm-cm to about $1.0\times10^{5}$ ohm-cm. Particular examples, such as iron oxides and copper oxides have resistivities of about $1\times10^{2}$ to about $1\times10^{5}$ ohm-cm.

In general, the non-carbonaceous resistivity modifier includes particulate material and as such, is not fiberous. In an example, the particulate material has an average particle size not greater than about 100 microns, such as not greater than about 45 microns or not greater than about 5 microns. For example, the particulate material may have an average particle size not greater than about 1000 nm, such as not greater than about 500 nm or not greater than about 200 nm. In a particular example, the average particle size of the particulate may be at least about 10 nm, such as at least about 50 nm or at least about 100 nm. In a particular example, the average particle size is in a range between about 100 nm and 200 nm.

In a particular embodiment, the particulate material has a low aspect ratio. The aspect ratio is an average ratio of the longest dimension of a particle to the second longest dimension perpendicular to the longest dimension. For example, the particulate material may have an average aspect ratio not greater than about 2.0, such as not greater than about 1.5, or about 1.0. In a particular example, the particulate material is generally spherical.

In an exemplary embodiment, the composite material includes at least about 67 wt % non-carbonaceous resistivity modifier. For example, the composite material may include at least about 70 wt % non-carbonaceous resistivity modifier, such as at least about 75 wt % non-carbonaceous resistivity modifier. However, too much resistivity modifier may adversely influence physical, electrical, or mechanical properties. As such, the composite material may include not greater than about 95 wt % non-carbonaceous resistivity modifier, such as not greater than about 90 wt % or not greater than about 85 wt % non-carbonaceous resistivity modifier.

In another exemplary embodiment, the composite material may include small amounts of a second filler, such as a metal oxide. In particular, the polymer matrix may include less than about 5.0 wt % of an oxide of boron, phosphorous, antimony or tungsten. Further, the composite material may include a coupling agent, a wetting agent, a surfactant, or any combination thereof. In a particular embodiment, the composite material is free of coupling agents, wetting agents, and surfactants.

The composite material may exhibit desirable surface resistivity and surface resistance. In an exemplary embodiment, the composite material exhibits a surface resistivity of about $1.0\times10^4$ ohm/sq to about $1.0\times10^{11}$ ohm/sq. For example, the composite material may exhibit a surface resistivity of about $1.0\times10^5$ ohm/sq to about $1.0\times10^{11}$ ohm/sq, such as about $1.0\times10^5$ ohm/sq to about $1.0\times10^9$ ohm/sq or about $1.0\times10^5$ ohm/sq to about $1.0\times10^7$ ohm/sq. In an exemplary embodiment, the composite material exhibits a surface resistance not greater than about $1.0\times10^{12}$ ohms, such as not greater than about $1.0\times10^9$ ohms, not greater than about $1.0\times10^8$ ohms, or not greater than about $5.0\times10^7$ ohms. For example, the composite material may exhibit a surface resistance not greater than about $5.0\times10^6$ ohms, such as not greater than about $1.0\times10^6$ ohms. In a particular embodiment, the surface resistance is not greater than about $9.0\times10^5$ ohms.

In addition, the composite material may exhibit a desirable volume resistivity. In an exemplary embodiment, the composite material exhibits a volume resistivity not greater than about $1.0\times10^8$ ohm-cm, such as not greater than about $5.0\times10^6$ ohm-cm. For example, the volume resistivity may be not greater than about $1.0\times10^5$ ohm-cm. Typically, the volume resistivity is about $1.0\times10^4$ to about $1.0\times10^{11}$ ohm-cm, such as about $1.0\times10^4$ to about $1.0\times10^8$ ohm-cm or about $1.0\times10^4$ to about $5.0\times10^6$ ohm-cm.

Further, the composite material may exhibit a desirable decay time. To measure decay time, a disc shaped sample is placed on a charged plate, voltage is applied to the plate, and an oscilloscope measures the dissipation time. For example, the decay time may be measured using an Ion Systems Charged Plate Monitor Model 210 CPM, a LeCroy 9310Am Dual 400 MHz Oscilloscope, and a Keithley 6517A electrometer. In an exemplary embodiment, the decay time is a measure of the time to dissipate static charge from 100V to 0V, relative to ground. For example, the composite material may exhibit a decay time of not greater than 1.0 seconds, such as not greater than 0.5 seconds, to dissipate static charge from 100V to 0V. In particular, the 100V decay time may be not greater than about 0.01 seconds, such as not greater than about 0.005 seconds, or even, not greater than about 0.0001 seconds. In another embodiment, the decay time is a measure of the time to dissipate static charge from 10V to 0V relative to ground. For example, the composite material may exhibit a decay time of not greater than about 1.0 seconds, such as not greater than about 0.05 seconds, not greater than about 0.01 seconds, or even, not greater than about 0.005 seconds, to dissipate static charge from 10V to 0V, relative to ground.

In particular embodiments, the electrical properties of the composite material may be tunable. For example, a Tunability Parameter is defined as the inverse of the maximum log-normal ratio of volume resistivity VR to resistivity modifier volume fraction (vf) (i.e., $\mathrm{abs}((\log VR_i - \log VR_{(i-1)})/(vf_i - vf_{(i-1)}))^{-1}$, wherein i represents a sample within a set of samples ordered by volume fraction). An exemplary embodiment of the composite material may have maximum log-normal ratio of at most about 0.75 and a Tunability Parameter of at least about 1.33. For example, the Tunability Parameter may be at least about 1.5, such as at least about 1.75. In contrast, a typical PEEK composite including a carbon black has a maximum log-normal ratio of 0.99 and a Tunability Parameter of 1.01.

The composite material may also exhibit desirable mechanical properties. For example, the composite material may have a desirable tensile strength relative to the polymer material absent the non-carbonaceous resistivity modifier. In an exemplary embodiment, the composite material has a Tensile Strength Performance, defined as the ratio of the tensile strength of the composite material to the tensile strength of the constituent polymer absent the non-carbonaceous resistivity modifier, of at least about 0.6. For example, the composite material may have a Tensile Strength Performance of at least about 0.7, or, in particular, at least about 0.75. In an embodiment, the composite material may exhibit a tensile strength of at least about 2.0 kN. In an example, the tensile strength of the composite material is at least about 2.5 kN, such as at least about 3.0 kN. In a further example, the peak stress (also referred to as tensile strength) may be at least about 50 MPa, such as at least about 75 MPa, or even at least about 90 MPa. The tensile strength may, for example, be determined using a standard technique, such as ASTM D638.

In another example, the composite material may exhibit a Young's modulus of at least about 5.0 GPa when measured at room temperature (about 25° C.). For example, the Young's modulus of the composite material may be at least about 6.0 GPa, such as at least about 7.5 GPa, at least about 9.0 GPa, or at least about 11.0 GPa. Particular embodiments exhibit a Young's modulus of at least about 25.0 GPa, such as at least about 75.0 GPa. Particular composite material embodiments may exhibit a Young's modulus of at least about 90 GPa, such as at least about 110 GPa, or even at least about 120 GPa.

In a further exemplary embodiment, the composite can be polished to exhibit a low surface roughness. For example, the composite can be polished such that at least a portion of the surface has a surface roughness (Ra) not greater than about 500 nm. In particular, the surface roughness (Ra) can be not greater than about 250 nm, such as not greater than about 100 nm. In a further example, the surface roughness (Rt) may be not greater than about 2.5 micrometers, such as not greater than about 2.0 micrometers. In an additional example, the surface roughness (Rv) may be not greater than about 0.5 micrometers, such as not greater than about 0.4 micrometers, or even, not greater than about 0.25 micrometers. In particular embodiments, the entire surface may have a low surface roughness.

In an additional exemplary embodiment, the composite material may exhibit a desirable coefficient of thermal expansion. For example, the composite material may exhibit a coefficient of thermal expansion not greater than about 50 ppm at 150° C. In particular, the coefficient of thermal expansion may be not greater than about 35 ppm, such as not greater than about 30 ppm at 150° C.

In an exemplary embodiment, the composite material may be formed by compounding a polymer and a non-carbonaceous resistivity modifier. For example, a polymer powder or polymer granules, such as polyetheretherketone (PEEK) powder, may be mixed with non-carbonaceous resistivity modifier particulate. In a particular embodiment, the polyetheretherketone (PEEK) powder and at least about 67 wt % of the non-carbonaceous resistivity modifier are mixed.

The mixture may be melted and blended to form a composite material. For example, the mixture may be blended at a temperature of at least about 300° C., such as at least about 350° C. or even, at least about 400° C. In a particular example, the mixture is blended and extruded to form an extrudate. The extrudate may be chopped, crushed, granulated, or pelletized.

In an exemplary embodiment, the composite material may be used to form an article. For example, the composite material can be extruded to form the article. In another example, the article can be molded from the composite material. For example, the article may be injection molded, hot compression molded, hot isostatically pressed, cold isostatically pressed, or any combination thereof.

Particular embodiment of the composite material advantageously exhibit desirable electrical properties, surface properties, and mechanical properties. For example, the composite material can exhibit desirable tensile strength and modulus in combination with desirable electrical properties. In addition, the composite material can exhibit desirable surface properties, such a low roughness, despite high loading of resistivity modifier.

In particular, the composite material may be used to form a tool useful for electronic device manufacturing. For example, the tool can include a device contacting component that is at least in part formed of a composite material including a thermoplastic polymer matrix and a non-carbonaceous resistivity modifier. In a particular example, the composite material may have a surface resistivity of about $1.0\times10^{4}$ ohm/sq to about $1.0\times10^{11}$ ohm/sq and a surface roughness (Ra) not greater than about 500 nm. In particular, the composite material may include at least about 67 wt % of the non-carbonaceous resistivity modifier.

Such a composite material is particularly useful for forming a device contacting component, such as a burn-in socket. In another example, the composite material can be used to form a vacuum chuck. In a further example, the composite material can be used to form tweezers, such as at least a portion of a tip of the tweezers. In a further example, the device contact component can include a pick-and-place device.

EXAMPLES

Example 1

Samples are prepared by compounding polyarylether ketone and 80 wt % iron oxide at a temperature of 400° C. The polyarylether ketone is 150-PF available from Victrex Polymer. The iron oxide has an average particle size of 0.3 micrometers. The samples are injection molded into sample shapes in accordance with testing standards.

The composite material exhibits a coefficient of thermal expansion of less than about 30 ppm at a temperature of 150° C. as measured using a Perkin Elmer TMA7 with Thermal Analysis Controller. The coefficient of thermal expansion is determined by heating a sample from room temperature to 250° C. at a rate of 10° C. per minute without load, cooling the sample, and heating the sample from room temperature to 250° C. at a rate of 5° C. per minute with a 50 mN load.

Figure 2:
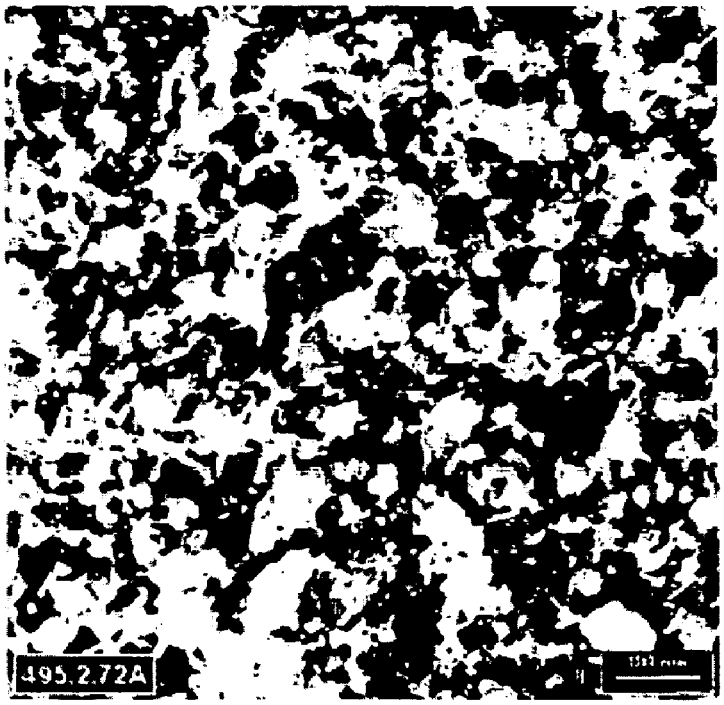

As illustrated in FIG. 1, the SEM image of a polished cross section of the resulting article exhibits a dispersed non-carbonaceous resistivity modifier and is substantially free of non-carbonaceous resistivity modifier agglomerates. Such substantially agglomerate free dispersion provides substantially invariant resistivity properties, reducing ESD risk associated with alternating regions of high and low resistivity. FIG. 2 includes an SEM image at higher magnification of a highly loaded composite. The dispersed non-carbonaceous resistivity modifier is separated by polymer and does not form agglomerates.

Further, the polished sample exhibits a surface roughness (Ra) in a range of 90 to 161 nm, having an average of 125 nm. In addition, the surface roughness (Rv) ranges from 0.1557 to 0.4035 microns, having an average surface roughness (Rv) of 0.2796, and the surface roughness (Rt) ranges from 0.4409 to 2.0219 microns, having an average surface roughness (Rt) of 1.231 microns. Surface roughness is measured in accordance with ANSI/ASME B46.1-1985.

Example 2

The Sample of Example 1 is tested for tensile strength and Young's Modulus in accordance with ASTM D638. In addition, a comparative sample of unfilled PEEK and a comparative sample of 450GL.30 PEEK having 30 wt % glass fiber are tested for tensile strength and Young's Modulus. Table 1 illustrates the results.

TABLE 1

Mechanical Properties of Filled PEEK

| | Modulus (GPa) | Tensile Strength (kN) |
|---|---|---|
| Sample 1 | 11.5 | 3.1 |
| PEEK 150 P (unfilled) | 3.2 | 4.1 |
| 450GL.30 PEEK | 7.3 | 5.6 |

As illustrated in Table 1, Sample 1 exhibits a Modulus of at least 11.0 GPa, significantly higher than unfilled PEEK and glass filled PEEK. In addition, Sample 1 exhibits a tensile strength of 3.1, at least 75% of the tensile strength of the unfilled PEEK.

Example 3

Six samples are prepared from 150-PF PEEK and approximately 80 wt % Alfa Aesar 12375 iron oxide. The samples are prepared in a Leistitz ZSE18HP 40D twin screw extruder at a temperature of 400° C.

The decay time is measured using an Ion Systems Charged Plate Monitor Model 210 CPM, a LeCroy 9310Am Dual 400 MHz Oscilloscope, and a Keithley 6517A electrometer. Measurements are made for discharge from 100 V and 10V. Surface resistance is measured using Prostat Corp. PRS-801 Resistance System at 100V.

TABLE 2

Electrical Properties of Composite Materials.

| | Avg. 100 V Decay Time ($10^{-4}$ s) | Avg. 10 V Decay Time ($10^{-3}$ s) | Avg. Surface Resistance ($10^{6}$ ohms) |
|---|---|---|---|
| Sample 2 | 9.9 | 2.5 | 21.5 |
| Sample 3 | 8.17 | 1.4 | 12.7 |
| Sample 4 | 6.18 | 1.1 | 13.7 |
| Sample 5 | 9.59 | 2.2 | 34.0 |
| Sample 6 | 39.0 | 5.1 | 99.0 |
| Sample 7 | 3.18 | 0.74 | 28.6 |
| Avg. | 12.67 | 2.06 | 34.9 |

As illustrated in TABLE 2, the 100V decay times for several samples are less than 0.001 seconds and the 10V decay times for several samples are less than 0.005 seconds. Sample 6 appears to be an anomaly. In addition, the surface resistance of the samples is between $1\times10^7$ ohms and $1\times10^8$ ohms.

Example 4

Composite samples are tested for tensile strength, elongation, and modulus. The samples include 150-PF PEEK and approximately 70 wt % to approximately 80 wt % Alfa Aesar 12375 iron oxide and are compounded in a Leistritz ZSE18HP-40D twin screw extruder at 400° C.

The mechanical properties are tested in accordance with ASTM D638 using a 0.2 in/min test speed and a 2000 lb Lebow load cell. Table 3 illustrates the results.

TABLE 3

Mechanical Properties of PEEK Composites

| | Composition (wt % $Fe_2O_3$) | Tensile Strength (MPa) | Elongation at Break (%) | Modulus (GPa) |
|---|---|---|---|---|
| Sample 8 | 70 | 94.7 | 0.149 | 75.45 |
| Sample 9 | 75 | 90.86 | 0.130 | 93.59 |
| Sample 10 | 75 | 98.38 | 0.131 | 91.81 |
| Sample 11 | 80 | 106.14 | 0.121 | 121.73 |

As illustrated in Table 3, the samples each exhibit a tensile strength of at least about 90 MPa, an elongation at least about 0.12%, and a modulus of at least about 75 GPa.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The invention claimed is:

1. A composite material comprising a thermoplastic polymer matrix and a non-carbonaceous resistivity modifier dispersed in the thermoplastic polymer matrix, the composite material having a surface resistivity of about $1.0\times10^4$ ohm/sq to about $1.0\times10^{11}$ ohm/sq, at least a portion of a surface of the composite material having a surface roughness (Ra) not greater than about 500 nm, the composite material having a Young's modulus of at least 11.0 Gpa.

2. The composite material of claim 1, wherein the surface roughness (Ra) is not greater than about 250 nm.

3. The composite material of claim 1, wherein the thermoplastic polymer matrix includes polyamide, polyphenylsulfide, polycarbonate, polyether, polyketone, polyarylether ketone, or any combination thereof.

4. The composite material of claim 1, wherein the thermoplastic polymer matrix includes a polymer having an ether bond between two monomers of the polymer.

5. The composite material of claim 4, wherein the polymer includes polyarylether ketone.

6. The composite material of claim 5, wherein the polyarylether ketone includes polyeteretherketone (PEEK).

7. The composite material of claim 1, wherein the non-carbonaceous resistivity modifier is substantially monodispersed.

8. The composite material of claim 1, wherein the surface resistivity is about $1.0\times10^5$ ohm/sq to about $1.0\times10^9$ ohm/sq.

9. The composite material of claim 1, wherein the composite material exhibits a decay time of not greater than about 1.0 seconds for a 100V decay.

10. The composite material of claim 1, wherein the non-carbonaceous resistivity modifier is an oxide, a carbide, a nitride, a boride, a sulfide, a silicide, a doped semiconductor, or any combination thereof.

11. The composite material of claim 10, wherein the non-carbonaceous resistivity modifier is selected from the group consisting of NiO, FeO, MnO, $Co_2O_3$, $Cr_2O_3$, CuO, $Cu_2O$, $Fe_2O_3$, $Ga_2O_3$, $In_2O_3$, $GeO_2$, $MnO_2$, $TiO_{2-x}$, $RuO_2$, $Rh_2O_3$, $V_2O_3$, $Nb_2O_5$, $Ta_2O_5$, $WO_3$, $SnO_2$, ZnO, $CeO_2$, $TiO_{2-x}$, ITO (indium-tin oxide), $MgTiO_3$, $CaTiO_3$, $BaTiO_3$, $SrTiO_3$, $LaCrO_3$, $LaFeO_3$, $LaMnO_3$, $YMnO_3$, $MgTiO_3F$, $FeTiO_3$, $SrSnO_3$, $CaSnO_3$, $LiNbO_3$, $Fe_3O_4$, $MgFe_2O_4$, $MnFe_2O_4$, $CoFe_2O_4$, $NiFe_2O_4$ $ZnFe_2O_4$, $Fe_2O_4$, $CoFe_2O_4$, $_{FeAl2}O_4$, $MnAl_2O_4$, $ZnAl_2O_4$, $ZnLa_2O_4$, $FeAl_2O_4$, $MgIn_2O_4$, $Mn_{In2}O_4$, $FeCr_2O_4$, $NiCr_2O_4$, $ZnGa_2O_4$, $LaTaO_4$, $NdTaO_4$, $BaFe_{12}O_{19}$, $3Y_2O_3.5Fe_2O_3$, $Bi_2Ru_2O_7$, $B_4C$, SiC, TiC, Ti(CN), $Cr_4C$, VC, ZrC, TaC, WC, $Si_3N_4$, TiN, Ti(ON), ZrN, HfN, $TiB_2$, $ZrB_2$, $CaB_6$, $LaB_6$, $NbB_2$, $MoSi_2$, ZnS, Doped-Si, doped SiGe, III-V, II-VI semiconductors, and any combination thereof

12. The composite material of claim 1, wherein the composite material comprises at least about 67 wt % of the non-carbonaceous resistivity modifier.

13. The composite material of claim 1, wherein the composite material comprises not greater than about 95 wt % of the non-carbonaceous resistivity modifier.

14. The composite material of claim 1, wherein the non-carbonaceous resistivity modifier has an average particle size of not greater than about 5 microns.

* * * * *